United States Patent [19]

Warnet et al.

[11] 4,190,736

[45] Feb. 26, 1980

[54] ELECTRICAL INSULATOR AND METHOD OF MAKING SAME

[75] Inventors: Henri Warnet, Laloubere; Paul Fouinat, Tarbes, both of France

[73] Assignee: Societe Anonyme Dite: Ceraver, Paris, France

[21] Appl. No.: 813,388

[22] Filed: Jul. 6, 1977

[30] Foreign Application Priority Data

Jul. 9, 1976 [FR] France ..... 76 21088

[51] Int. Cl.[2] ..... H01B 17/02; H01B 19/00

[52] U.S. Cl. ..... 174/209; 29/631; 156/294; 174/179; 174/186; 264/262

[58] Field of Search ..... 174/30, 138 D, 176, 174/177, 178, 179, 186, 188, 194, 195, 209, 211; 29/631; 156/79, 294; 264/262, DIG. 54; 428/376, 397, 398

[56] References Cited

U.S. PATENT DOCUMENTS

| | | | |
|---|---|---|---|
| 1,728,531 | 9/1929 | Estorff | 174/186 X |
| 2,997,529 | 8/1961 | Fink | 174/179 X |
| 3,110,758 | 11/1963 | Meier | 174/179 X |

FOREIGN PATENT DOCUMENTS

| | | | |
|---|---|---|---|
| Ad.71395 | 6/1959 | France | 174/179 |
| 1470629 | 1/1967 | France | 174/179 |
| 466396 | 1/1969 | Switzerland | 174/179 |
| 1048434 | 11/1966 | United Kingdom | 174/194 |
| 1182045 | 2/1970 | United Kingdom | 174/179 |

*Primary Examiner*—Laramie E. Askin

*Attorney, Agent, or Firm*—Sughrue, Rothwell, Mion, Zinn and Macpeak

[57] ABSTRACT

Electrical insulator comprising an ouer tube of dielectric material filled with blocks of dielectric foam and sealed at its ends.

The filling is manufactured independently of the tube in a material of substantially compatible coefficient of thermal expansion. The filling is connected to the inner surface of the tube by an adhesive interface material which provides good mechanical and electrical connection between the tube and its filling.

Application to electrical insulators which are of large diameter and/or great length.

6 Claims, 4 Drawing Figures

ELECTRICAL INSULATOR AND METHOD OF MAKING SAME

FIELD OF THE INVENTION

The present invention relates to a tubular electrical insulator, comprising an outer tube of dielectric material, an inner filling of dielectric material and sealing means at each end of the tube.

BACKGROUND OF THE INVENTION

The outer tube may have any shape; it may be smooth or it may be profiled in such a way as to obtain a lengthened leakage path, and it should be made of a dielectric material of sufficient mechanical strength (ceramics, glass, organic or inorganic fibres bonded in a synthetic resin, etc.).

Solid shanked electrical insulators made of ceramic material, of glass or of organic or inorganic fibres by a hardenable resin have excellent electrical properties, but it is difficult to manufacture such insulators having a large diameter, greater than about 200 to 250 mm for ceramic insulators or greater than an even smaller diameter (50 mm) for insulators of fiber-resin composite materials.

The use of tubular insulators may be considered; these can be manufactured with large diameters and/or great lengths and may be filled with a rigid foam filling of synthetic resin applied in situ for the purpose of providing electrical insulation and water-tight sealing. Nonetheless, there remains the problem of obtaining good adhesion between the rigid foam and the inner wall of the tube since the skin formed by the rigid foam on contact with the wall is brittle and runs the risk of not being able to withstand the strains likely to arise in use, which will reduce the electrical insulation properties. Further, it is practically impossible to make long insulators in this way which have substantially constant electrical insulation properties along their entire length. Finally, the application of the rigid foam in situ requires very tight working conditions (temperature control, mixing time for the constituants of the foam, etc.) and if these are not complied with there is no check on the quality of the foam, and faults such as air inclusions and unsticking from the inner wall of the tube cannot be avoided.

The present invention thus has the aim of providing a tubular insulator which may have a large diameter and/or great length and in which it is easy to check the quality of the filler of insulating material and to ensure permanent adhesion in service to the inner wall, thus maintaining its electrical insulating properties constant, but whose manufacture is nonetheless simple and does not require excessive precautions.

SUMMARY OF THE INVENTION

The tubular electric insulator according to the invention is characterised in that the internal filling is made independently of the tube out of a foam material which is at least partially rigid, and in that it is connected to the inner wall of the tube by an interface material which provides good mechanical and electrical linkage between the material of the tube and that of the filling.

It, preferably, also includes at least one of the following characteristics:

- the filling is a foam of the most rigid category of polyurethane,

- the filling is formed by at least one block of synthetic resin foam previously machined to a diameter close to the internal diameter of the tube and stuck to the wall of the tube by a synthetic resin,
- the periphery of the block of foam is provided with longitudinal passages for pouring the adhesive synthetic resin for sticking to the tube wall and is provided with guide means for centering it in its housing,
- the filling comprises a plurality of superposed blocks of foam,
- the flexible adhesive synthetic resin is an epoxy resin,
- the filling is of a dielectric foam whose coefficient of thermal expansion is near that of the tube,
- the interface material is a flexible foam obtained by polymerization of a liquid at ambient temperature which turns into a foam in a controlled atmosphere at greater than ambient temperature,
- the tube is of ceramic material and its inner wall is not glazed,
- the tube is of fibres bound by a hardenable synthetic resin and the inner surface of the tube is wiped by an abrasive, and
- sealing means at the ends of the tube are silicon elastomer seals.

The foam material for internal filling must be sufficiently rigid to allow the synthetic resin for sticking to the wall to flow past it without retracting under the pressure of the sticking resin. A very flexible foam material, such as foam rubber, would not be suitable.

The method of manufacturing a tubular electrical insulator filled internally with at least one block of an at least partially rigid synthetic resin foam is characterised in that the said block is machined to a diameter near to the internal diameter of the tube, in that the said block is centred and inserted into the tube, in that the ends of the tube are provided with caps having vents, in that a hardenable synthetic liquid polymer is degassed into a flexible resin preferably mixed with a hardening catalyst in the liquid phase, in that the hardenable synthetic liquid polymer is inserted into the tubular insulator via one of its ends under the effect of an applied pressure and/or reduction of pressure at the opposite end, at least until it reaches the opposite end, then in that the interior of the insulator is isolated from its feed, and finally in that the said hardenable synthetic liquid polymer is allowed to harden.

It preferably also includes at least one of the following characteristics:

- the insulator provided with its hardenable synthetic liquid polymer is heated to a temperature and for a sufficient length of time to ensure the complete hardening of the said synthetic liquid polymer;
- the effect of the applied pressure and/or the reduce pressure is maintained for about 20 to 30 minutes after the synthetic liquid polymer has appeared at the end of the insulator opposite to the end at which it is introduced; and
- after the interior of the insulator has been isolated from its synthetic liquid polymer feed it is left in communication with the source of reduced pressure for several minutes in order to perfect the degassing.

When the internal filling is made of a dielectric material whose thermal coefficient of expansion is near to that of the tube, at least one block of the said material is introduced and centred in the tube, the inner surface of the tube and the outer surface of the block are covered in a product which is liquid at ambient temperature and which is capable of forming a foam in a controlled atmosphere by being heated above ambient temperature, the ends of the tube are sealed and the tube is heated to a sufficient temperature for the product to turn into a foam. A liquid resin of silicone or of urethane may be used as the interface product for this purpose, since on heating in the presence of an appropriate catalyst they turn respectively into a foam of silicone rubber or of polyurethane.

A tubular electrical insulator embodying the invention and filled with a foam of polyurethane of a quality known as "rigid" and using an interface material of epoxy resin is described below by way of an example with reference to the figures of the accompanying drawings, as is the method of manufacture.

DESCRIPTION OF THE PREFERRED EMBODIMENT

Figure 1:
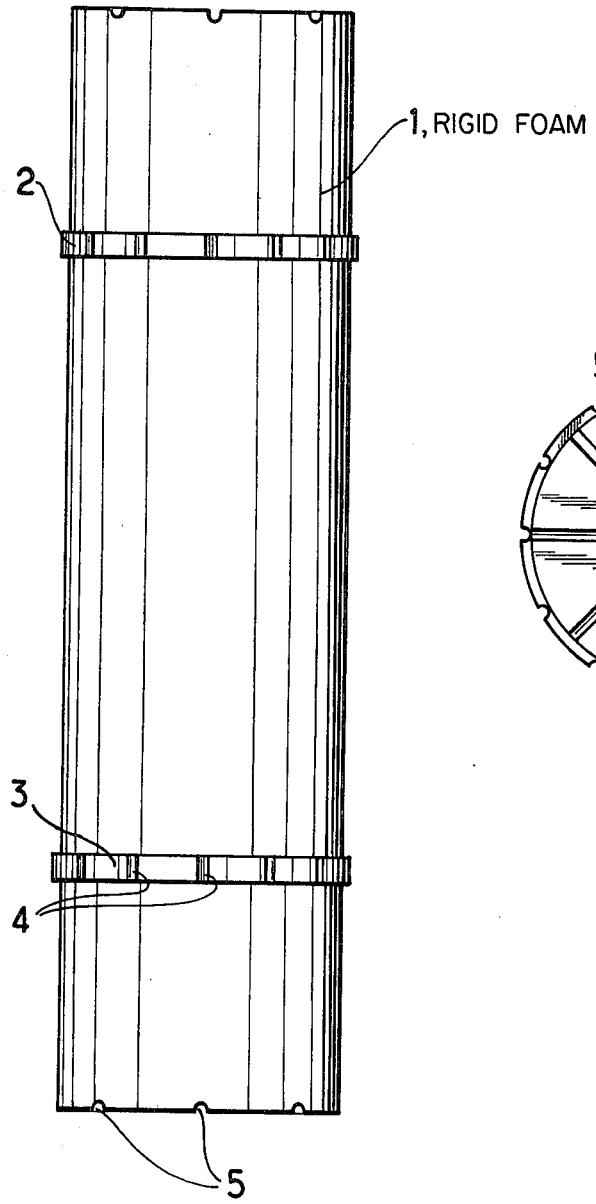
FIG. 1 is an elevation of a block of "rigid" foam for introduction into a tubular insulator.
Figure 2:
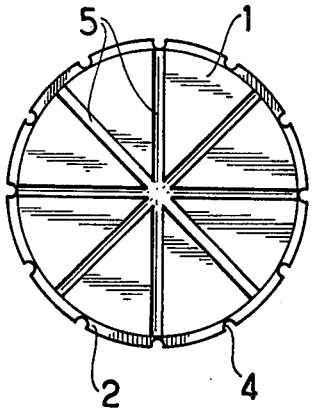
FIG. 2 is a plan view of the end of the block of "rigid" foam.

In FIG. 1, the body 1 of a block of rigid polyurethane foam, with a density for example of 80 to 100 Kg per $m^3$, has two collars 2 and 3 whose diameters are a few millimeters larger than that of the body of the block and whose thicknesses are of a few millimeters and which are provided with longitudinal notches such as 4 at regular angular intervals. At its ends, the body 1 has diametrically oriented grooves 5, better seen in FIG. 2, for providing an even distribution of the adhesive synthetic resin about the insulating block.

Figure 3:
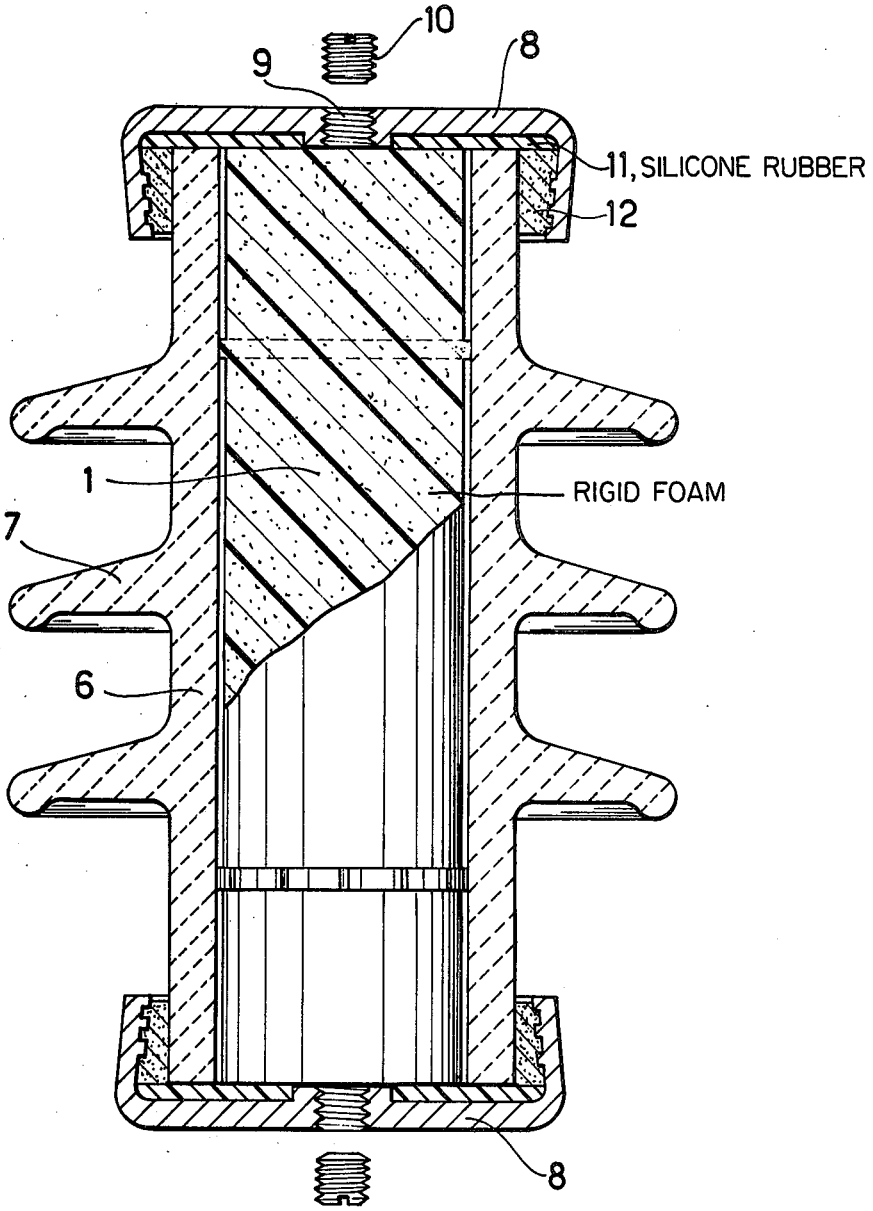
FIG. 3 is an axial section of an insulator provided with an internal block of "rigid" foam before the introduction of the synthetic resin for sticking the block of foam.

FIG. 3 shows, in axial section, an insulator provided with a block of rigid polyurethane foam and with end caps to seal the ends before the operation of introducing the adhesive synthetic resin. The ceramic tube 6 of the insulator has an unglazed internal surface and has the usual discs 7 on the exterior surface. A tube of wound glass fibre set in synthetic resin could also be used. Its inner surface would then be dry-wiped with mill balls of ceramics and abrasive alumina or by any other means. Although the tube has been drawn as though relatively short, for greater clarity in the drawing, it will be understood that longer tubes are generally used in practice and that they are then filled with several superposed cylinders of rigid polyurethane foam. The caps 8 are pierced at their centres by threaded holes 9 which can be closed by grub screws 10 and glued for perfect sealing. Sealing between a cap and its end of the insulator is provided by a seal 11 and by a sealing cement 12. The seal 11 is silicone elastomer stuck to the cap either by casting in situ or by subsequent application thereto.

Figure 4:
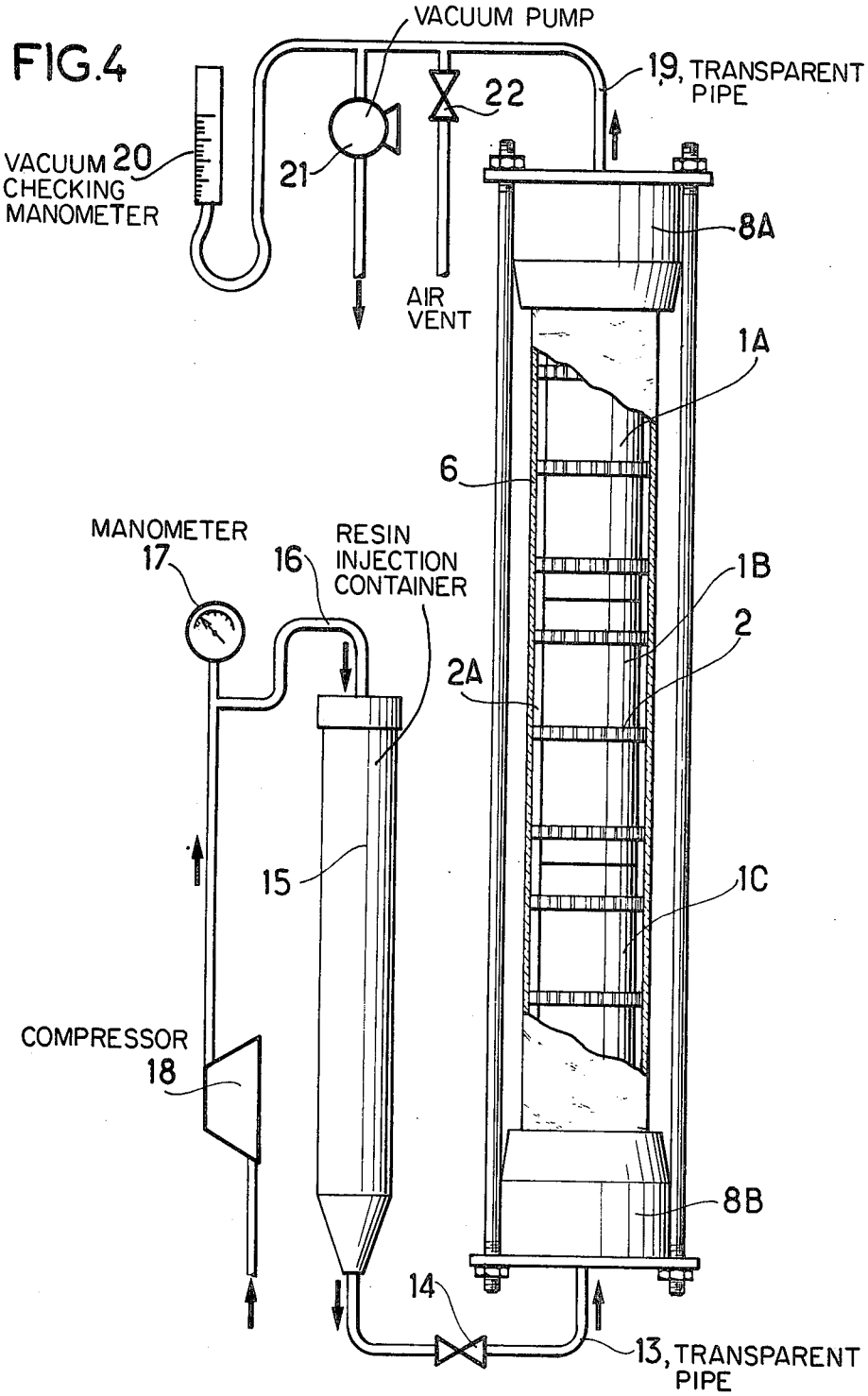
FIG. 4 is a diagram of a device for introducing the adhesive synthetic resin into the insulator.

FIG. 4 shows a device for introducing the adhesive synthetic resin into the insulator. In this drawing the insulator is shown filled with three blocks of rigid polyurethane foam 1A, 1B and 1C. It is connected by a transparent tube 13 provided with a valve 14 to an injection container 15. The container is filled with a mixture of epoxy resin and hardening catalyst of the type sold under the trademark "Araldite," and previously degassed by exposure to a vacuum. The container 15 is connected by its other end to a pipe 16 provided with a manometer 17 and a compressor 18.

At the other end the interior of the tube 6 is connected by a transparent pipe 19 provided with a vacuum checking manometer 20 to a vacuum pump 21 and to an air vent 22.

The operation of filling the insulator can take place as follows:

The blocks of rigid polyurethane foam 1A, 1B and 1C are pushed into the insulator. The positioning collars 2 of these blocks divide the space remaining inside the insulator into peripheral casting passages such as 2A. Caps 8A and 8B are applied to the ends of the tube and are sealed thereto. Threaded rings (not shown) disposed at the end of the tubes 13 and 19 are then screwed into the threaded holes of the caps. A mixture of epoxy resin and hardener is prepared such that its viscosity at 25° C. is about 3600 to 4000 centipoise and is then degassed and introduced into the injection container 15. The valve 14 is then closed and the vacuum pump 21 started so as to leave a residual pressure inside the tube of 15 to 70 millibars. The valve 14 is then opened slowly and the compressor 18 started so as to provide an over pressure of 0.1 to 0.3 bar above the epoxy resin in the container 15. This causes the resin to rise in the insulator tube. When the resin starts to rise in the pipe 19 the valve 14 is closed and the vent 22 is progressively opened so as to progressively reduce the vacuum in the pipe 19.

The threaded rings can then be removed from the caps which are then sealed. The epoxy resin is then hardened in the insulator tube, either by leaving it for a sufficient period of time at ambient temperature or by heating it slightly during an appropriate length of time.

Thermal cycling tests carried out on a test tube analogous to that shown in FIG. 4 but made of glass and filled with blocks of polyurethane foam have shown that after spending 8 hours at −28° C. followed by 15 hours at +20° C. there was no unsticking of the interface between the glass and the foam. After spending 8 hours at −25° C. followed by 15 hours at +70° C. followed by a return to ambient temperature there was likewise no unsticking at the interface. Compensation for differential expansion and contraction between the tube and the polyurethane is ensured by the voids in the foam. The dielectric strength measured on a test tube cut up in a block of the same resin as that with which the tube is filled, came to 31.5 KV/mm, a value comparable to that of a good ceramic insulator.

Insulators embodying the invention may be used as insulators on electrical apparatus, as insulator arms on apparatus for working on high tension lines etc. The insulators work in a wide range of temperatures which can be made to extend from −15° C. to +80° C.

Although the insulator and the manufacturing method which have just been described with reference to the figures of the accompanying drawing seen to be preferable, it will be understood that numerous modifications can be made to them without going beyond the scope of the invention. Various units or materials of the insulator and various steps of the method are replaceable by others which perform the same technical function. In particular, a foam which is at least partially rigid of another resin can be used as the filling, e.g. epoxy, silicone or phenolic resin. A different resin can be used to stick the blocks to the tube provided it is sufficiently flexible after hardening, e.g. polyester resin. The adhesive resin may be introduced by the effect of the vacuum alone or by the effect of the over pressure alone.

What is claimed is:

1. An electrical insulator comprising an independently manufactured outer tube of a dielectric material selected from the group consisting of ceramic material and wound glass fibers set in a synthetic resin, a filling of at least partially rigid independently manufactured dielectric foam material, sealing means at each end of said tube, and an adhesive interface material connecting said filling to the inner surface of the tube along the length thereof and providing a good electrical and mechanical connection between the material of the tube and that of the filling, said filling comprising at least one block of said dielectric foam material machined to a diameter close to the internal diameter of said tube, said block being stuck to the wall of said tube by a synthetic resin constituting said adhesive interface material, said block having radially projecting, integral guide means for centering it in said tube, and said radially projecting guide means being provided with longitudinal passages about the periphery thereof for permitting the synthetic resin constituting said adhesive interface material to pass between said guide means and the inner surface of the tube.

2. An electrical insulator according to claim 1, wherein said block of dielectric foam material is provided at its ends, near the ends of the insulator, with diametrically oriented grooves.

3. A method of manufacturing an electrical insulator including the steps of:

providing at least one independently manufactured block of at least partially rigid synthetic resin foam, providing an independently manufactured insulator tube, machining said block to a diameter near to the internal diameter of the tube, centering and inserting the block into the tube, degassing a hardenable synthetic liquid polymer into a flexible resin mixed with a hardening catalyst in the liquid phase, feeding the hardenable synthetic liquid polymer into the insulator tube via one of its ends under the effect of an applied pressure differential between the ends, isolating the flexible resin within the interior of the insulator tube from the resin being fed thereto, maintaining the pressure differential for about 20 to 30 minutes after the synthetic liquid polymer has appeared at the end of the insulator which is opposite to that end at which it is introduced, and finally hardening said hardenable synthetic liquid polymer.

4. The method according to claim 3, further comprising the step of maintaining the interior of the insulator tube after it has been isolated from the source of flexible resin, being fed to the insulator tube, in communication with a source of reduced pressure for several minutes in order to complete degassing.

5. The method according to claim 3, wherein subsequent to feeding the hardenable synthetic liquid polymer into the insulator tube, the step of hardening comprises heating said hardenable synthetic liquid polymer at a temperature for a length of time sufficient to insure the complete hardening of said synthetic liquid polymer.

6. A method of manufacturing an electrical insulator including the steps of:

providing an independently manufactured insulator tube, providing at least one independently manufactured block of at least partially rigid synthetic resin foam, machining said block to a diameter near to the internal diameter of the tube, centering and inserting said block into said tube, degassing a hardenable synthetic liquid polymer into a flexible resin mixed with a hardening catalyst in the liquid phase, feeding the hardenable synthetic liquid polymer into the insulator tube via one of its ends under the effect of an applied pressure differential between the ends, isolating said flexible resin within the interior of the insulator tube from the flexible resin being fed to the tube, maintaining communication with a source of reduced pressure of said flexible resin within said tube after the interior of the insulator tube has been isolated for several minutes in order to complete degassing, and finally hardening said hardenable synthetic liquid polymer.

* * * * *